United States Patent [19]

Morrison et al.

[11] 4,347,713

[45] Sep. 7, 1982

[54] DEVICE FOR CHILLING CONDIMENTS AND THE LIKE

[75] Inventors: Howard J. Morrison, Deerfield; Douglas P. Montague, Chicago, both of Ill.

[73] Assignee: Marvin Glass & Associates, Chicago, Ill.

[21] Appl. No.: 222,961

[22] Filed: Jan. 7, 1981

[51] Int. Cl.[3] ..... F25D 3/08

[52] U.S. Cl. ..... 62/371; 62/457; 62/459; 62/464; 62/529

[58] Field of Search ..... 62/457, 371, 372, 529, 62/530, 459, 463, 464; 220/94 A, 20

[56] References Cited

U.S. PATENT DOCUMENTS

| | | | |
|---|---|---|---|
| 264,186 | 9/1882 | Miller | 62/371 X |
| 297,887 | 4/1884 | Watson | 62/371 |
| 1,027,660 | 5/1912 | Larrance | 62/371 X |
| 2,652,698 | 9/1953 | Schlumbohn | 62/457 X |
| 2,673,454 | 3/1954 | Gallie et al. | 62/457 |
| 3,178,903 | 4/1965 | Proctor | 62/464 X |
| 3,240,030 | 3/1966 | Peters et al. | 62/457 X |
| 3,255,607 | 6/1966 | Bair et al. | 62/457 X |
| 3,506,154 | 4/1970 | Barnes | 220/94 A |
| 3,605,433 | 9/1971 | Strathaus | 62/459 X |
| 3,654,773 | 4/1972 | White | 62/457 X |
| 3,791,547 | 2/1974 | Branscum | 62/371 X |
| 3,938,691 | 2/1976 | Dumas | 220/94 A |
| 4,286,440 | 9/1981 | Taylor | 62/457 |

FOREIGN PATENT DOCUMENTS

| | | | |
|---|---|---|---|
| 21922 | 10/1905 | Austria | 62/463 |
| 254998 | 7/1926 | United Kingdom | 62/457 |

*Primary Examiner*—Lloyd L. King

*Attorney, Agent, or Firm*—McDermott, Will & Emery

[57] ABSTRACT

A portable and self-contained ice bucket combination having a compartmentalized portion for chilling condiments and the like. The ice bucket includes an insulated vessel or base portion for defining a chamber within which cooling a media, such as ice may be stored. The vessel is open ended at the top and includes a complementary support structure for placement and support of a compartmentalized condiment tray thereon in communication with the cooling media while serving as a cover or closure for the vessel. The compartmentalized tray defines a plurality of compartments within which condiments and the like may be placed for chilling and serving. In addition, the tray includes a second compartment serving the dual purposes of containing similar articles and functioning as a handle for removing the tray from the top of the vessel. An annular cover plate is included for placement over the condiment tray for storage or transporting from one location to another.

8 Claims, 5 Drawing Figures

Fig 1
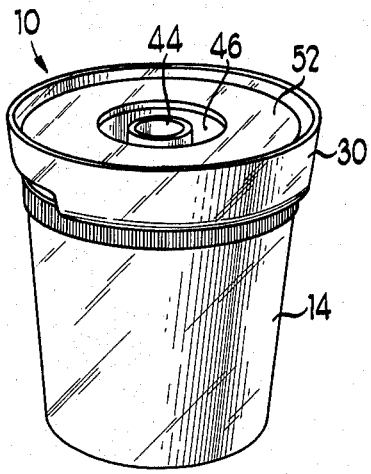
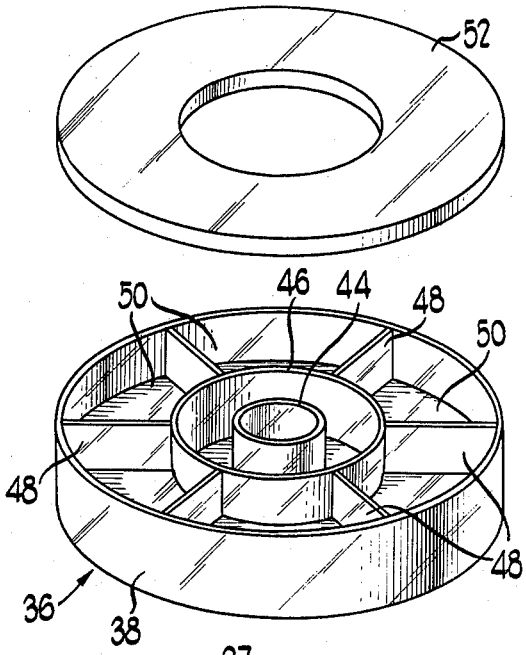
Fig 2
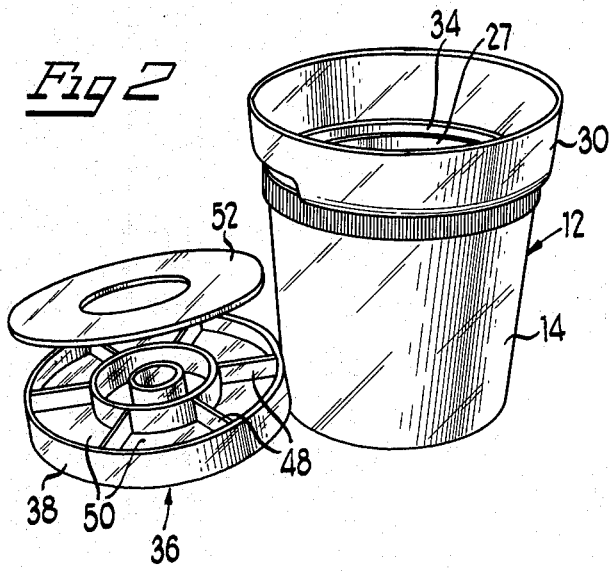
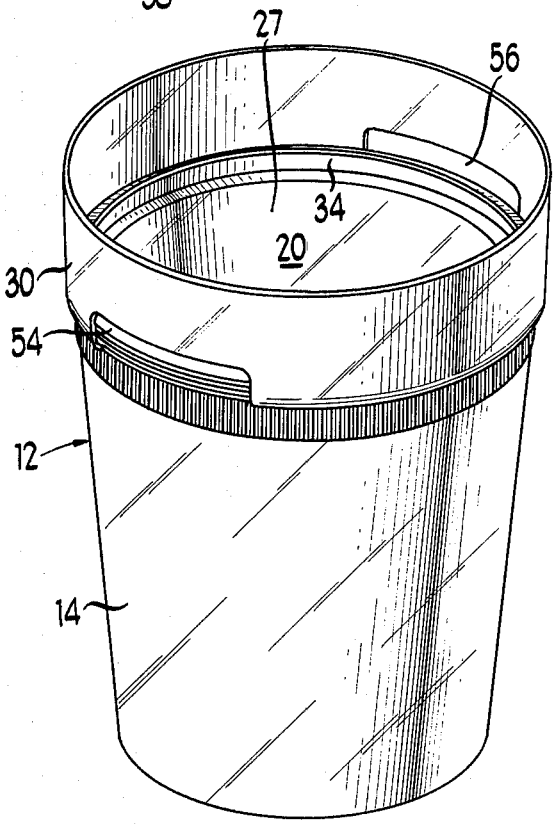
Fig 3
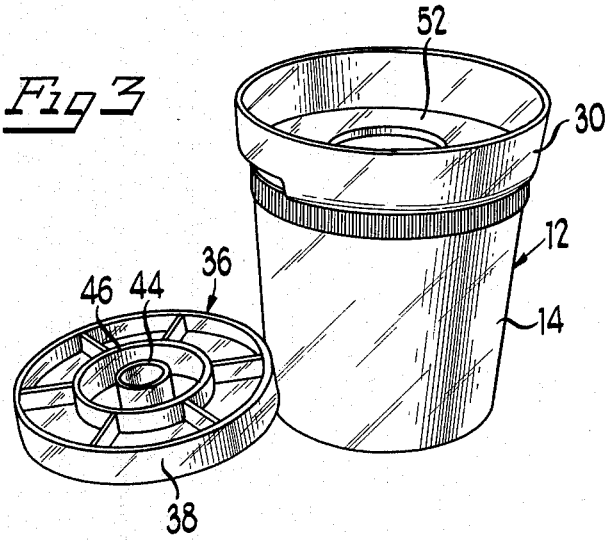
Fig 4

DEVICE FOR CHILLING CONDIMENTS AND THE LIKE

BACKGROUND OF THE INVENTION

A. Field of the Invention

The present invention relates to a new and improved portable and self-contained device for chilling condiments and the like.

B. Description of the Prior Art

At parties, picnics and other functions, various condiments such as drink related items for example, olives, toothpicks, lemons, limes and the like are used by the guests. Often a condiment tray is used and passed around to the guests. A typical prior art embodiment tray is simply a tray fabricated from glass or similar material that has several compartments defined on one surface to allow the placement of separate items such as olives, limes, lemons and similar condiments.

Althouh such a prior art tray may be portable and passed from one guest to another at a party or a picnic, the tray must be placed on a table or on a central location and left during the entire picnic or party. As a result, the tray approaches the ambient temperature that is normally above the proper temperature for insuring that the condiments are fresh and consequently the condiments loose their taste. Moreover, the typical condiment tray is difficult to transport from one location in a room to another during a party or to be packed and transported in a picnic basket. This is typically due to the fact that prior art trays do not include a covering device. If the condiment tray is transported, the condiments are stored over a longer period of time without remaining in a cool environment thus resulting in the possibility that once the condiments are served, they are already at the ambient temperature and somewhat wilted thereby reducing the desirability and taste of the condiments. In addition the typical prior art condiment tray normally does not include additional compartments or holding structure for non-food type items such as toothpicks.

SUMMARY OF THE INVENTION

An object of the present invention is to provide a new and improved combination ice bucket and condiment tray.

Another object of the present invention is to provide a new and improved portable and self-contained condiment tray that continuously cools the condiments.

The present invention is directed to a new and improved device for containing condiments and the like and for cooling the condiments to a preferred temperature while keeping them at the preferred temperature for prolonged periods of time. The device is also self-contained and portable to allow it to be conveniently located. The device of the present invention is easily transportable and may be carried to a bar. The device of the present invention is intended to chill condiments before being used and may also be used to maintain them at a preferred temperature during serving thereby insuring the freshness and enhanced taste of the condiments throughout the period of use.

The device of the present invention includes a lightweight vessel which is insulated by a dead air space or other means and includes a receptacle therein for containment of a chilling media such as ice. The vessel is insulated in a manner such that although the inside contains cooling media, the insulation prevents condensation on the outside surface. The vessel includes an open top within which is removably positioned a condiment tray that includes one or more partitions that define compartments for containing condiments. The tray is fabricated from a lightweight material that may be rapidly cooled by the cooling media to a desired temperature and maintained at that temperature over a long period of time. The tray allows the placement of a variety of condiments such as olives, pickles, onions, lemon peels or twists, limes and other condiments which may be used to make various mixed drinks.

In addition, th tray includes a central portion that functions to contain accessory items such as toothpicks and also may be grasped as a handle to lift the tray out of the vessel providing easy access to the ice below and then returned to the vessel to remain cool. In this manner the condiments are always fresh and their taste is enhanced both before and during serving.

A cover may also be included to be positioned over the condiment tray to allow it to be transported from one location to another without substantially increasing the temperature and also to prevent spilling durin transportation.

BRIEF DESCRIPTION OF THE DRAWINGS

The above and other objects and advantages and novel features of the present invention will become apparent from the following detailed description of a preferred embodiment of the invention illustrated in the accompanying drawings wherein:

FIG. 1 is a perspective view of a preferred embodiment of an assembled device constructed in accordance with the principles of the present invention;

FIG. 2 is a perspective view of the device of the present invention disassembled to illustrate the cover portion and a compartmentalized tray;

FIG. 3 is a perspective view illustrating an alternate assembly with the cover portion closing the top of the vessel and the condiment tray placed inside the vessel;

FIG. 4 is an enlarged exploded view of the device of the present invention.

DETAILED DESCRIPTION OF THE PREFERRED EMBODIMENT

Figure 5:
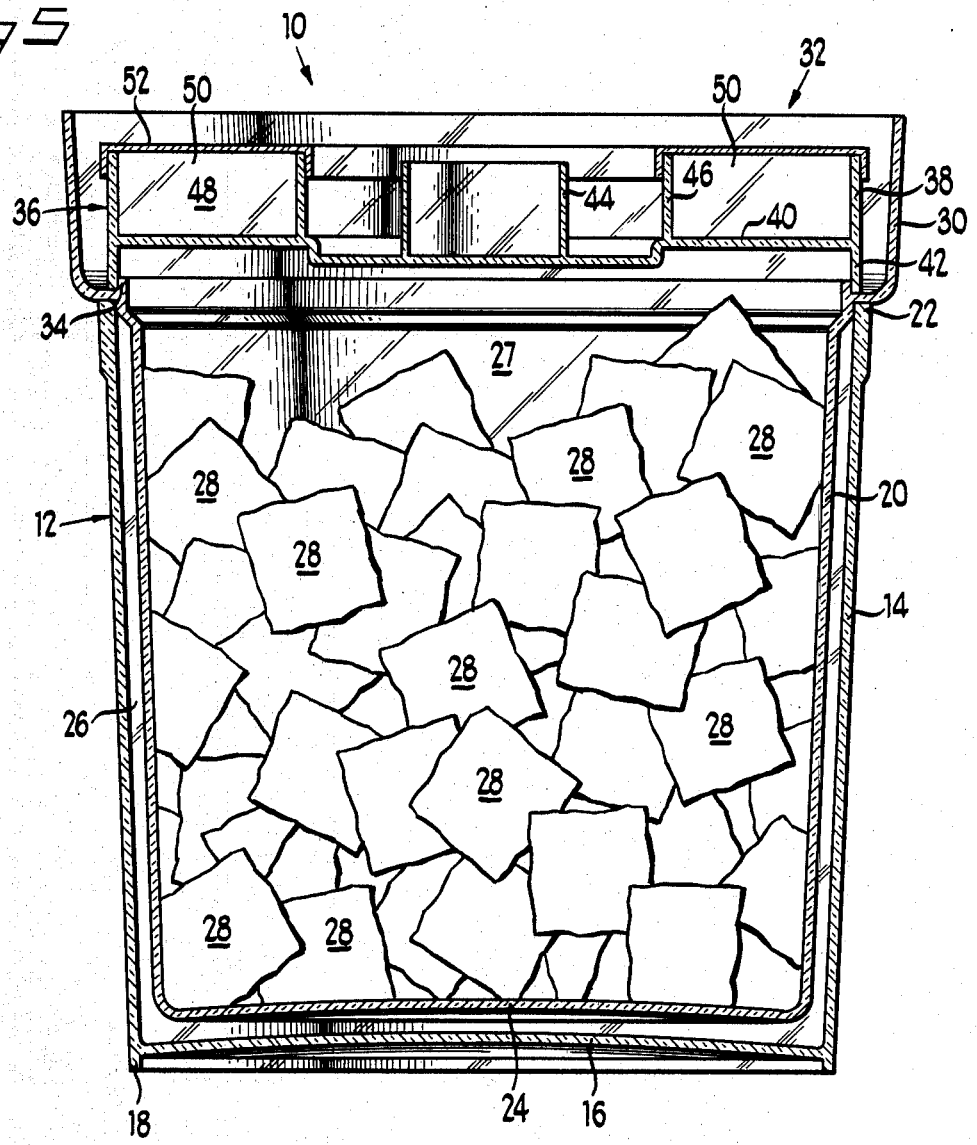
FIG. 5 is an enlarged vertical, cross-sectional view showing the detail of the present invention.

Referring now to the drawings, there is illustrated a device generally designated by the reference numeral 10 intended for use as a combination ice bucket and tray for cooling condiments and the like. The device 10, as illustrated, is portable and self-contained to allow it to be easily transported from one location to another such as from the kitchen to a bar area. Since the device 10 is portable and self-contained, it may also be placed in different locations in a party room without the necessity of being close to a source of energy such as an electric outlet. The purpose of the tray portion of the chilling device 10 is to chill condiments or the like both before and during serving thereby insuring freshness of the condiments during use.

The device 10 is constructed of a lightweight material such as plastic and the like enhancing its ability to be transported or passed around at a party, but also is unbreakable and rapid cooled to a preferred temperature once a cooling media such as ice is added. The device 10 as illustrated in FIGS. 2–5 includes a vessel portion, generally designated by the reference numeral 12, that is defined by an outer wall 14 that in the preferred embodiment illustrated is cylindrical in configuration. A bottom wall 16 is defined at the lower end of the cylindrical wall 14 at a location to delinate a lower rim 18 on which the vessel 12 is positioned so as to space the bottom wall slightly above a supporting surface such as a table and the like.

The vessel 12 also includes a second, inner wall 20 that is also of a cylindrical configuration and is secured to an upper flange 22 of the outer wall 14 such as by glue or the like. The inner wall 20 only contacts the outer wall 14 at the upper flange 22 and the remaining portion of the inner wall 20 including a bottom portion 24 thereof is spaced slightly from the outer wall 14 and its bottom 16 such that there is a dead air space 26 defined therebetween. The dead air space 26 functions as an insulating medium between the inner wall 20 and the outer wall 14 thereby insulating any cooling media such as ice 28 that is placed within a receptacle 27 defined within the inner wall 20. It should be understood that in addition to a dead air space 26 between the inner and outer walls 20 and 14, other insulating materials may be employed if so desired to enhance the insulation characteristics. The dead air space 26 also functions to prevent moisture accumulation on the outer surface of the outer wall 14 when a cooling media 28 is placed within the receptacle 27. Accordingly, the portable chilling device 10 may be placed on wooden furniture and may be moved without difficulty in handling due to accumulation of moisture on the outer wall 14 thereof.

The inner wall 20 includes a radially outwardly extending integral flange 30 that defines an open end 32. The inner wall 20 further includes a second perpendicular or vertical extending flange 34 adjacent to the interface 22 between the outer wall 14 and the inner wall 20. This flange or rim 34 defines a holding structure for a condiment tray generally designated by the reference numeral 36.

The condiment tray 36 is circular in configuration and includes a circular upstanding sidewall 38 and an undulating bottom wall 40 that intersects the sidewall 38 at a location to define a downward depending rim or support member 42. It is intended that the downwardly extending rim 42 may be positioned around and against the rim 34 to allow easy placement and removal of the tray 36 from the location illustrated in FIG. 5 wherein the opening 32 of the vessel 12 is covered by the tray 36. As best illustrated in FIG. 5, the tray 36 is closely adjacent to the cooling media 28 and is cooled thereby. The tray 36 is preferably constructed of the same material as the vessel 12 and is of a type of plastic or the like that may be rapidly cooled and maintained at a preferred temperature.

Turning now to FIG. 4, the tray 36 in the preferred embodiment illustrated includes a central ring or cylinder 44 surrounded by a second concentric ring 46. Walls or webs 48 extend radially outwardly from the ring 46 and intersect the outer wall 38 to define a plurality of individual compartments 50. The individual compartments 50 may be employed for the placement of drink condiments such as olives, small onions, lemon twists, orange or lime sections, and the like. In addition, the inner ring 44 is designed for the holding of accessory items such as toothpicks and also functions as a handle such that a person may grasp the ring 44 by the fingers and lift the tray 36 out of the vessel 12 to provide access to the ice below. Thereafter, the tray 36 may be returned to the vessel 12 and placed in the opening 32. In this manner, the tray 36 and the condiments stored therein are maintained at a preferred temperature enhancing the taste and insuring freshness.

To assist in transportation of the device 10 and to avoid spilling of condiments in the tray 36 a cover 52 may also be included and is of a dimension to fit onto the top of the tray 36 within the opening 32 of the vessel 12. The cover 52 allows the chilling device 10 to be easily transported without spilling the contents of the tray 36 and allows the chilling device 10 to be packed in a container for transportation from one location to another.

The chilling device 10 also includes diametrically opposed slots 54 and 56 fabricated in the flange 30 to allow the insertion of fingers thereby allowing easy carrying of the chilling device 10 from one location to another.

What is claimed and sought to be covered by Letters Patent of the United States is:

1. A portable, self-contained device for chilling condiments and the like, comprising:
   - a vessel including means for containing cooling media such as ice and the like;
   - means for insulating said vessel and said containing means;
   - a carrying member removably mounted in said vessel adjacent said cooling media, said carrying member including means defining at least one compartment for containing said condiments and the like, said carrying member further comprises a portion thereof that defines both a compartment and a handle for gripping and removing said carrying member from said vessel, and a cover removably positioned on said carrying member, said cover including an opening through which said portion of said carrying member extends wherein said portion may be grasped to remove said tray and said cover.

2. The chilling device set forth in claim 1 further comprising a removable cover for said carrying member.

3. The chilling device set forth in claim 1 wherein said insulating means comprises a first wall and a second wall spaced therefrom defining a dead air space therebetween.

4. The chilling device set forth in claim 1 further comprising handles on said vessel to allow carrying of said chilling device, said handles defined by apertures in said vessel of a size to allow insertion of the fingers of a user.

5. A chilling device comprising:
   - a housing defining a receptacle for containing a cooling material;
   - means for holding a device adjacent said cooling material, said holding means comprising a circular flange defined on said housing; and
   - a tray removably held by said holding means, said tray including first means for defining at least one compartment thereon and second means for defining a handle to allow removal of said tray from said device, said second means comprises a circular flange defined on said tray and defining a compartment for condiments.

6. The device claimed in claim 5 further comprising a cover for said tray.

7. The device claimed in claim 5 further comprising means for insulating said housing.

8. A device for chilling condiments and the like, comprising:

a housing with an open end, an annular flange on said open end;

a wall in said housing and spaced therefrom to define an insulating space;

a pair of handles defined in said annular flange by a pair of apertures therein;

a ledge defined by said annular flange and said housing;

a condiment tray removably positioned on said ledge, said condiment tray including a bottom, an upstanding wall, a central annular wall on said bottom defining a handle for grasping and removing said tray from said ledge and defining a compartment for condiments, a plurality of walls radially extending from said central annular wall to said upstanding wall to define a plurality of compartments for condiments, and a cover removably positioned on said tray, said cover including a central aperture through which said central annular wall extends wherein said central annular wall may be grasped to remove said tray and said cover.

* * * * *